United States Patent [19]

Hodges

[11] 4,025,033

[45] May 24, 1977

[54] APPARATUS FOR DISPENSING A BONDING AGENT

[76] Inventor: Lee R. Hodges, 14073 Passage Way, Largo, Fla. 33540

[22] Filed: Oct. 2, 1975

[21] Appl. No.: 618,745

Related U.S. Application Data

[63] Continuation-in-part of Ser. No. 493,139, July 7, 1974, abandoned.

[52] U.S. Cl. ..... 228/33; 164/332; 164/309

[51] Int. Cl.[2] ..... B24B 13/00

[58] Field of Search ..... 164/119, 309, 310, 311, 164/332, 334; 425/808; 51/216 LP, 277; 269/7; 228/33

[56] References Cited

UNITED STATES PATENTS

| | | | |
|---|---|---|---|
| 2,344,589 | 3/1944 | Bogner | 228/33 |
| 3,032,841 | 5/1962 | Sylvester | 164/119 |
| 3,221,378 | 12/1965 | Faas et al. | 164/334 |
| 3,468,366 | 9/1969 | Suddarth | 164/332 |

*Primary Examiner*—James L. Jones, Jr.
*Assistant Examiner*—K. J. Ramsey
*Attorney, Agent, or Firm*—Arthur W. Fisher, III

[57] ABSTRACT

An apparatus dispensing a molten metal alloy bonding agent for bonding a lens block to a lens blank. The apparatus comprises a pneumatically pressurized vessel including a thermostatically controlled heating element to dispense molten metal alloy therefrom. The apparatus further includes a control valve to selectively control the flow of molten metal alloy from the vessel.

6 Claims, 2 Drawing Figures

APPARATUS FOR DISPENSING A BONDING AGENT

This is a continuation in-part of co-pending application Ser. No. 493,139, filed July 7, 1974, now abandoned.

BACKGROUND OF THE INVENTION

1. Field of the Invention

An apparatus dispensing a molten metal alloy bonding agent for bonding a lens block to a lens blank.

2. Description of the Prior Art

In the ophthalmic industry eyeglass lens blanks must have a method of orientating the optical axis and as well as a means of holding and driving them for the purpose of grinding, lapping and polishing the prescription into said blank lens, and edging them to achieve a proper fit into eyeglass frames when using modern optical machinery.

Low melting temperature metal alloy or similar substance is used in the ophthalmic industry for bonding or forming a block to both plastic and glass lens blanks so that they may be orientated to the optical axis and be driven to be ground, polished and edged to the proper prescription.

However, devices which have been previously described suffer from either inadequate or irregular rate of flow of the bonding substance or a cavitating of the substance from between the said lens and work block. Another problem in the area of plastic lenses is the criticality of temperature control. This is due to the fact that alloys generally melt at approximately 117° Farenheit and plastic lenses become adversely affected if the temperature rises above 120° Farenheit. Previously described devices sense the temperature of the vessel, not the alloy or substance proper. Since the alloy develops thermal layers in its molten state, this does not give an adequate indication of actual alloy temperature. Therefore causing plastic lenses to warp. Whereas this invention overcomes these deficiences by pressurising the vessel to provide an even constant flow in conjunction with an externally controlled valve. Secondly the thermostat device is submerged directly in the alloy or similar substance and is located at the level of the discharge orifice providing very accurate control of the temperature.

SUMMARY OF THE INVENTION

The present invention relates to an apparatus dispensing a molten metal alloy bonding agent for bonding a lens block to a lens blank. More specifically, the apparatus comprises a heated pressurized vessel including a discharge orifice and a sensitive thermostat positioned in direct contact with a molten metal alloy or similar substance and located at the same level as the discharge orifice. An externally control valve or control means controls the flow from the vessel.

The apparatus is constructed such that sufficient heat is applied to the vessel and discharge path to keep metal alloys or similar substances molten while maintaining a tolerance of the temperature within + or − 1° Farenheit. Further by employing a regulated pneumatic pressure directly upon the molten metal alloy the flow of alloy is closely controlled at a substantially constant rate without the aid of mechanical pump, piston arrangement, or gravity feed.

It has been found that by the use of this apparatus, the lens blocking process is possible at a rate of at least twice as fast as heretofore possible because of the regular flow and less temperature difference between molten and solid stae of the substance being used. Moreover plastic lenses do not warp because of excessive heat. Further because of the lack of moving parts in the alloy stream, there is no need to continually replace mechanical parts of the mechanism as is the case with current devices used for the same purpose.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the invention reference should be had to the following detailed description in connection with the accompanying drawings.

Similar reference characters refer to similar parts throughout the views of the drawing.

DETAILED DESCRIPTION OF THE PREFERRED EMBODIMENT

Figure 2:
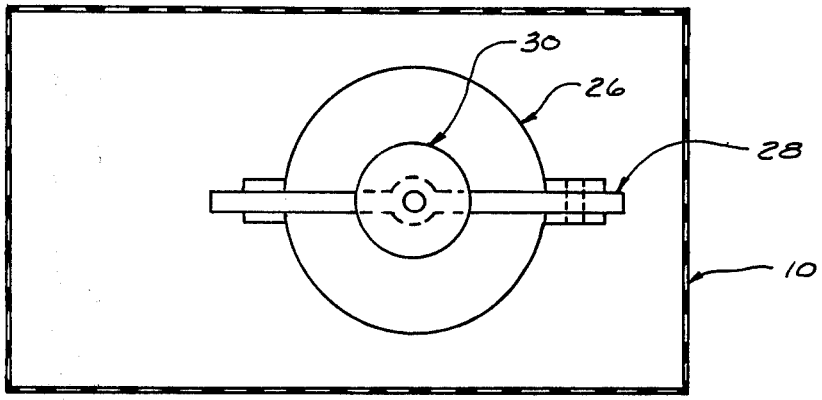
FIG. 2 is a cross-sectional top view of the present invention taken along line 2—2 of FIG. 1.
Figure 1:
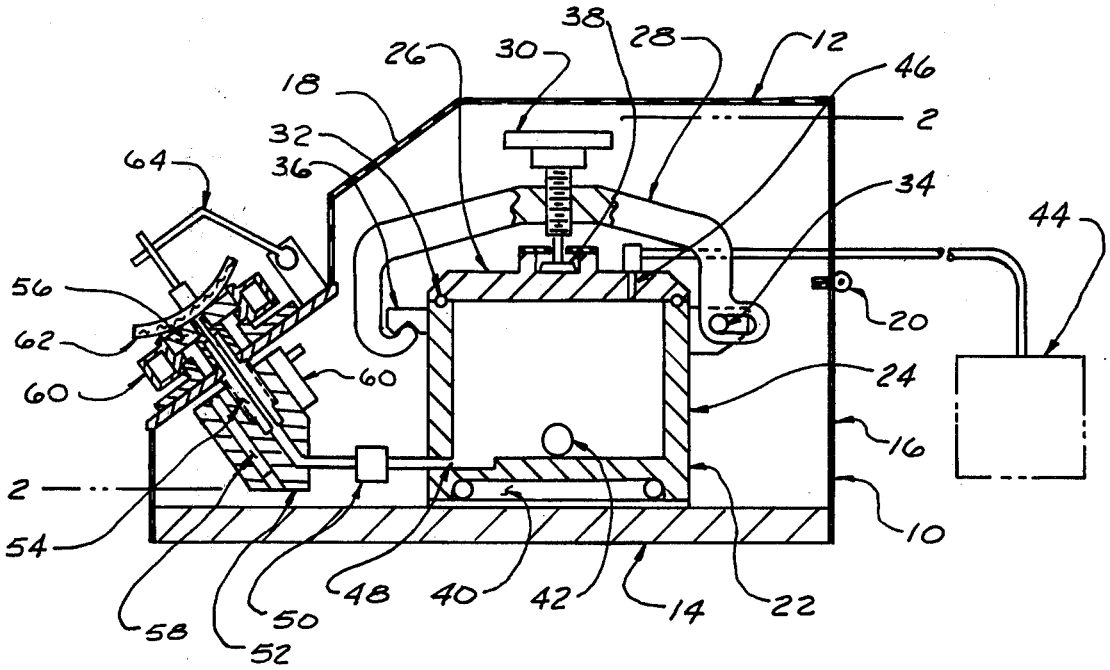
FIG. 1 is a cross-sectional side view of the present invention.

As shown in FIGS. 1 and 2, this invention comprises an apparatus for dispensing a molten metal alloy bonding agent for bonding a lens block to a lens blank generally indicated as 10. As seen in FIG. 1, the apparatus 10 includes a cabinet 12 comprising a base 14, lower cover 16 and cabinet lid 18. The cabinet lid 18 is pivotally attached to the lower cover 16 at 20.

Fastened to the base 14 is a hollow vessel 22 comprising a vessel body 24, vessel lid 26, latch arm 28 and handwheel 30. The vessel 22 is sealed by means of O-seal ring 32. The latch arm 28 is pivotally mounted to the vessel 24 at 34 on one side and disposed to engage latch 36 on the opposite side. By rotating handwheel 30, which is threaded on latch arm 28, pressure is exerted on lid 26 through swivel foot 38.

The vessel 22 is heated by means of electrical heating element 40. The bonding agent, such as metal alloy, in the vessel 22 is melted by this heating element 40. A sensitive thermostat 42 is submerged in the molten metal alloy to sense the actual temperature of the bonding agent and control the heating element 40. The vessel 22 is pressurized by an external compressed air or pressurization means 44 regulated between 3 to 5 P.S.I. through a pressure feed orifice 46 in lid 26. Of course, the pressure feed orifice 46 may be formed in vessel body 24 so long as it is disposed above the alloy level.

The vessel 22 includes a discharge orifice 48 leading to externally operated control valve or flow control means 50. The valve 50 is a normally closed valve and is manually activated only when a discharge of allow is desired. Alloy then flows into a heated secondary block 52. An adjustable discharge nozzle 54 is affixed to the secondary block 52. It is this adjustable nozzle 54 on which a standard metallic block 56 is disposed. The secondary block 52 is heated by electrical heating element 58 controlled by thermostat 60. It should be noted that the temperature in this area is not as critical as in the vessel 22 since only a small quantity of the molten bonding agent is concerned here and is in motion while being dispensed.

From the secondary block 52 alloy flows through adjustable nozzle 54 into the standard metallic block 56. The metallic block 56 is disposed on a water cooled locating ring 60. Lens blank 62 is held in place during dispensing and cooling by means of retaining clamp 64.

In operation the liquid cooled ring 60 is placed on the apparatus 10 over adjustable nozzle 54. A metallic block 56 is then placed in liquid cooled ring 60 over nozzle 54. The glass or plastic lens blank 62, which is to be "Blocked" is placed in desired relationship relative to metallic block 56. The lens blank 62 is held in place by means of the manually operated clamp 64. Valve 50 is then manually opened. Alloy is forced through orifice 48 at a controlled rate by the air pressure which is exerted directly upon the alloy. The cavity between the lens blank 62 and the metallic block 56 is thus filled with alloy. The liquid cooled ring 60 dissipates the heat and the molten material quickly solidifies.

It will thus be seen that the objects set forth above, among those made apparent from the preceeding description, are efficiently attained, and since certain changes may be made in carrying out the above methods and article without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described.

I claim:

1. An apparatus for dispensing molten material for bonding a lens block and lens blank together, said apparatus comprising:

a. a hollow vessel including a vessel body having a vessel lid pivotally attached thereto, said vessel body having a discharge orifice formed therein and said vessel lid having a pressure feed orifice formed thereon;

b. a heating element disposed in the lower portion of said vessel body to heat the interior of said vessel;

c. a flow control means operatively coupled to the interior of said vessel through said discharge orifice, said flow control means movable between a first and second position;

d. means including a retaining clamp and a discharge nozzle coupled to said flow control means to support the lens block and lens blank in operative engagement relative to each other, said retaining clamp disposed to engage the lens blank and said discharge nozzle extending through the mid-portion of the lens block and disposed to feed molten material to the interface between the lens blank and lens block;

e. a second heating element affixed to said discharge nozzle to heat the molten material adjacent said vessel discharge nozzle;

f. pressurization means operatively coupled to the interior of said vessel through said pressure feed orifice such that pressure is applied through said pressure feed orifice against the molten material within said vessel, the molten metal flowing from the interior of said vessel through said discharge orifice and said discharge nozzle to the lens block and lens blank when said flow control means is in said firt position under a substantially constant flow rate, the molten material being isolated from said discharge nozzle when said flow control means is in said second position.

2. The apparatus of claim 1 wherein said pressurization means comprises an external pressure regulated compressed air source acting directly upon the molten material.

3. The apparatus of claim 1 further including temperature sensing means coupled to said heating element to control the the temperature of the molen metal alloy, said temperature sensing means disposed to contact directly with the molten material.

4. The apparatus of claim 3 wherein said temperature sensing means is disposed adjacent said discharge orifice.

5. The apparatus of claim 1 wherein said flow control means comprises a two position poppet valve.

6. The apparatus of claim 1 further including a liquid cooled ring mounted on said discharge nozzle to cool the molten material between the lens block and lens blank.

* * * * *